United States Patent [19]

Friedrich et al.

[11] 4,070,190

[45] Jan. 24, 1978

[54] PROCESS FOR PRODUCING PHOTOGRAPHIC SILVER HALIDE EMULSIONS HAVING A CORE/SHELL STRUCTURE

[75] Inventors: Wolfgang Friedrich, Urberach; Horst Friedel, Frankfurt am Main; Erhard Jury, Nieder-Morlen, all of Germany

[73] Assignee: E. I. Du Pont de Nemours and Company, Wilmington, Del.

[21] Appl. No.: 716,469

[22] Filed: Aug. 23, 1976

Related U.S. Application Data

[63] Continuation of Ser. No. 496,853, Aug. 12, 1974.

[30] Foreign Application Priority Data

Sept. 3, 1973 Germany ..... 2344331

[51] Int. Cl.[2] ..... G03C 1/02

[52] U.S. Cl. ..... 96/94 R; 96/114.8

[58] Field of Search ..... 96/94 R, 107, 114.8

[56] References Cited

U.S. PATENT DOCUMENTS

| | | | |
|---|---|---|---|
| 2,592,250 | 4/1952 | Davey et al. | 96/94 R |
| 3,477,852 | 11/1969 | Allentoff | 96/94 R |
| 3,561,971 | 2/1971 | Pestalozzi | 96/94 R |
| 3,957,488 | 5/1976 | Klotzer et al. | 96/94 R |

*Primary Examiner*—David Klein
*Assistant Examiner*—L. Falasco

[57] ABSTRACT

The invention is a process of producing a lithographic silver halide emulsion having a core/shell structure exhibiting improved halftone dot quality and increased photographic speed, comprising: (1) precipitating a silver chloride emulsion in a protective colloid, (2) converting said silver chloride emulsion to a silver bromide emulsion, and (3) precipitating a silver chloride shell on the surfaces of the silver bromide grains.

6 Claims, No Drawings

PROCESS FOR PRODUCING PHOTOGRAPHIC SILVER HALIDE EMULSIONS HAVING A CORE/SHELL STRUCTURE

This is a continuation, of application Ser. No. 496,853, filed Aug. 12, 1974.

BACKGROUND OF THE INVENTION

The subject of the present invention is a process for producing lith emulsions with improved general sensitivity.

The silver halide emulsions used in the photographic industry for producing lith films must have a very steep gradation and a good dot quality, that is, the dots must possess high density and edge sharpness. This is accomplished by use of emulsions for this purpose having a narrow grain-size distribution and a high proportion of chloride. As a rule, such emulsions contain at least 60 mole percent of chloride and less than 40 mole percent of bromide. However, it is a disadvantage that these emulsions possess a relatively small general sensitivity which is not sufficient for many areas of application in reproduction technology. Thus, for the direct imaging of lith emulsions on electronic color scanners or on reproduction cameras and on reproduction enlargement devices, a high general sensitivity is required which cannot be achieved with the conventional, predominantly chloride-containing emulsions produced by the single or double stream method.

From the German patent No. 1,169,290, published Apr. 30, 1964, photographic silver halide emulsions are known that are characterized by an extremely narrow grain-size distribution. According to one particular embodiment, silver halide emulsions can be obtained according to this process in which the grains display a core/shell structure. However, in practice it has been found that these practically monodisperse emulsions can be sensitized chemically to an adequate extent only with difficulty, so that the high general sensitivity necessary for the present purpose cannot be achieved. This state of affairs is referred to for example in the German Offenlegungsschrift No. 2,042,188, published Mar. 18, 1971. It is also disadvantageous that unusually long precipitation times are required for the production of these emulsions and that, in addition, expensive production equipment with special automatic control and dosing devices, and the like, are necessary. Moreover, it is known that silver halide emulsions can also be prepared by the conversion method, which are characterized by a relatively narrow grain-size distribution. For example, such silver halide emulsions of the conversion type are disclosed in U.S. Pat. No. 2,592,250. As is evident from U.S. Pat. No. 3,703,584 there are also difficulties in raising the sensitivity of these emulsions to a sufficient degree.

Therefore, the object of the present invention is to provide a process for producing silver halide emulsions which possess a narrow grain-size distribution and the typical lith properties, such as steep gradation and good dot quality, but at the same time also possess an extraordinarily high general sensitivity compared to the conventional lith emulsions.

SUMMARY OF THE INVENTION

The objects of the invention are accomplished by the process comprising:

1. precipitating a silver chloride emulsion in a protective colloid, 2. converting said silver chloride emulsion to a silver bromide emulsion, and 3. precipitating a silver chloride shell on the surfaces of the silver bromide grains.

In the above process the silver chloride shell and the silver bromide conversion emulsion which forms the core may contain up to 5 mole percent silver iodide. According to the invention, lithographic silver halide emulsions with a core/shell structure which exhibit improved halftone dot quality and increased photographic speed are produced.

That emulsions with a core/shell structure could be produced according to the process of the invention, that were characterized by an increased general sensitivity, compared to those of German Pat. No. 1,169,290, was completely surprising, since it is known that both the conversion emulsions and also the emulsions of the German Pat. No. 1,169,290 can be sensitized only with difficulty.

DESCRIPTION OF THE PREFERRED EMBODIMENTS

The process of the invention can be carried out simply according to the customary precipitation methods as a one-stream or a two-stream process. The one-stream method is preferably used to form the silver bromide core, and the two-stream method can be used for precipitating the shell. The precipitation is carried out in a protective colloid, such as gelatin, as is well known in the art. Suitable protective colloids are among the colloid binding agents described in U.S. Pat. Nos. 3,155,506 and 3,249,440.

Thus, for example, the practical conduct of the process may consist in producing a silver chloride emulsion by rapidly adding a 10% solution of silver nitrate to a given solution of a chloride and gelatin in water. Subsequently, the precipitated silver chloride emulsion is digested for several minutes at elevated temperatures. For conversion, an aqueous solution of a bromide is then added in equimolar quantity based on the precipitated silver. Suitable for this purpose are soluble bromides, such as, sodium bromide, potassium bromide and ammonium bromide. In many case, the bromide solution may contain a small quantity of a water-soluble iodide. After digestion for a short time, the chloride shell is then precipitated on. In doing this, the quantity of the precipitated silver chloride is to be adjusted so that the chloride/bromide molar ratio at the end of the precipitation is located between 50/50 and 95/5.

To produce core/shell emulsions with a chloride bromide molar ratio of up to 60/40, it is generally sufficient to add a silver nitrate solution, since the chloride present in the solution, liberated in the conversion, is sufficient for precipitating on the shell.

If emulsions are to be produced with a higher chloride/bromide ratio, a water-soluble chloride is preferably added simultaneously with the silver nitrate solution, in doing which the chloride solution may contain a small quantity of a water-soluble iodide. For further processing, the emulsion is then flocculated in a known manner, freed from the excess soluble salts by washing and redispersed. Chemical sensitization is accomplished with the customary sulfur sensitizers and/or the noble metal salts known for this purpose. In addition, the emulsions may contain rhodium salts, polyoxyalkylene compounds, stabilizers, wetting agents, hardeners and other additives. According to a preferred embodiment, the noble metal salts and the rhodium compounds can be added to the precipitating solutions.

The emulsions can be sensitized with the customary optical sensitizers outside the region of inherent sensitivity. Addition of the optical sensitizers can take place during the digestion or before casting the emulsion. Production of the emulsions according to the invention places no particular demands on the processing technology and can be accomplished in any simple emulsion-producing arrangement.

According to an especially advantageous embodiment of the invention, the bromide solution used for the conversion and the chloride solution used for precipitating on the shell may contain a small proportion of iodide. On the whole, this iodide fraction can amount to up to 5 mole percent, preferably 1%, however.

It has been found to be advantageous to adjust the quantity of chloride precipitated on so that the chloride/bromide molar ratio is located between 70/30 and 90/10.

The invention will be described in more detail through the following examples:

EXAMPLE 1

Sample A

A core/shell emulsion according to the invention with a chloride/bromide ratio of 80/20 is produced as follows: To 210 ml of a given 1 molar $NH_4Cl$ solution, which contains 20 g of gelatin, is added rapidly 400 ml of a 0.5 molar solution of $AgNO_3$. After precipitation of the chloride emulsion is completed, conversion is accomplished through addition of an equimolar quantity of an $NH_4Br$ solution.

Then, for precipitating on a chloride shell, 800 ml of a 1 molar $AgNO_3$ solution and 600 ml of a 1 molar $NH_4Cl$ solution containing 20 g of gelatin are added to the conversion emulsion.

Sample B

As a comparison, a conventional lith emulsion with a chlorine/bromide ratio of 80/20 is produced: To 200 ml of a 1 molar $NH_4Cl$ solution containing 20 g of gelatin are added simultaneously 1000 ml of a 1 molar $AgNO_3$ solution and a mixture of 800 ml of a 1 molar $NH_4Cl$ solution containing 20 g of gelatin and 200 ml of a 1 molar $NH_4Br$ solution.

Subsequently, both emulsions are flocculated, freed from the soluble salts by washing, redispersed and sensitized with the customary methods and means in the same manner chemically and optically. Thereafter, the emulsions are cast on a customary film support and dried.

On a sample of each of the two film materials, in the form of the known test strips, is exposed a gray wedge with a gradient of 0.15 cm and a gray raster. For exposure, a commercial flash sensitometer is used. The exposure time amounts to $10^{-3}$ sec. Subsequent development is for 3 min at 20° C in a lith developer with the following composition:

| | |
|---|---|
| Solution A | |
| Hydroquinone | 15.0 g |
| Sodium formaldehyde bisulfite | 70.0 g |
| Sodium sulfite anhydrous | 0.6 g |
| Water make up to | 500 ml |
| Solution B | |
| Sodium carbonate anhydrous | 60.0 g |
| Sodium bicarbonate | 10.0 g |
| Potassium bromide | 1.0 g |
| Water make up to | 500 ml |

For use, the two solutions are mixed in a 1:1 ratio. Then the sensitivity is measured with a commercial density measuring device with a raster density of 0.3, that is, a 50% dot area.

For simplicity in comparison, the sensitivity of the conventional lith emulsion is set equal to 100. Besides, the dot quality of the two samples is determined. For this, through microscopic examination of the screen reproductions, the dots are evaluated for edge sharpness, dot size, light opacity of small dots, etc. and the halftone dot quality evaluation is presented on a numerical scale from 1 to 6. The results obtained in doing this are summarized in Table 1:

Table 1

| | Sample | Relative sensitivity (3 min/20° C) | Dot quality |
|---|---|---|---|
| A | Emulsion according to the invention | 210 | 2 |
| B | Conventional lith emuslion | 100 | 2.5 |

A dot quality up to 3 is quite usable for practical purposes, while a dot quality of 4 and more is unsatisfactory to unusable.

EXAMPLE 2

Sample A

Following the procedure of German Pat. No. 1,169,290, a core/shell emulsion with a chloride/bromide ratio of 80/20 is produced as follows:

To 50 ml of a 5% gelatin solution are added through metering pumps 100 ml of a 2 N $AgNO_3$ solution and 100 ml of a 2 N $NH_4Br$ solution, keeping the silver ion concentration constant automatically at the minimum solubility of AgBr. The gelatin concentration is held at about 5% through addition of gelatin during the precipitation process.

Then, 400 ml of 2 N $AgNO_3$ solution and 400 ml of 2 N $NH_4Cl$ solution are added simultaneously to this emulsion, likewise using metering pumps and maintaining the silver ion concentration constant automatically at the minimum of solubility of AgCl and the concentration of gelatin is held at 5%.

Sample B

A conventional lith emulsion with a chloride/bromide ratio of 80/20 is produced: To 200 ml of a 1 molar $NH_4Cl$ solution containing 20 g of gelatin are added simultaneously 1000 ml of a 1 molar $AgNO_3$ solution and a mixture of 800 ml of a 1 molar $NH_4Cl$ solution containing 20 g of gelatin and 200 ml of a 1 molar $NH_4Br$ solution.

Sample C

A core/shell emulsion according to the invention, with a chloride/bromide ratio of 80/20 is produced as follows: To 210 ml of a given 1 molar $NH_4Cl$ solution, that contains 20 g of gelatin, is added rapidly 400 ml of a 0.5 molar $AgNO_3$ solution. After precipitation of the chloride emulsion is completed, conversion is accomplished through addition of an equimolar quantity of an $NH_4Br$ solution.

Then, to precipitate a chloride shell on the conversion emulsion, 800 ml of a 1 molar $AgNO_3$ solution and 600 ml of a 1 molar $NH_4Cl$ solution containing 20 g of gelatin are added simultaneously.

All three samples are processed further according to the information in Example 1 and exposed and developed according to the methods given there. The values for sensitivity and dot quality obtained are compiled in Table 2.

Table 2.

| Sample | Relative sensitivity (3 min/20° C) | Dot quality |
|---|---|---|
| A | 70 | 3.0 |
| B | 100 | 2.5 |
| C | 210 | 2.0 |

EXAMPLE 3

Sample A

A core/shell emulsion is produced with a chloride/-bromide ratio of 80/19, in which the converted bromide emulsion contains 1% of iodide: To 210 ml of a given 1 molar $NH_4Cl$ solution, which contains 20 g of gelatin, is added rapidly 400 ml of a 0.5 molar $AgNO_3$ solution. After precipitation of the chloride emulsion is completed, conversion is accomplished through addition of a mixture of 190 ml of a 1 molar $NH_4Br$ solution and 10 ml of a 1 molar $NH_4I$ solution.

To precipitate on a chloride shell, 800 ml of a 1 molar $AgNO_3$ solution and 600 ml of a 1 molar $NH_4Cl$ solution containing 20 g of gelatin are added simultaneously to the conversion emulsion.

Sample B

A core/shell emulsion is produced with a chloride/-bromide ratio of 79/20, in which the chloride shell contains 1% of iodide: To 200 ml of a given 1 molar $NH_4Cl$ solution, that contains 20 g of gelatin, is added rapidly 400 ml of a 0.5 molar solution of $AgNO_3$. After precipitation of the chloride emulsion is completed, conversion is accomplished through addition of an equimolar quantity of an $NH_4Br$ solution.

To precipitate on a chloride shell, 800 ml of a 1 molar $AgNO_3$ solution and a mixture of 590 ml of a 1 molar $NH_4Cl$ solution containing 20 g of gelatin and 10 ml of a 1 molar $NH_4I$ solution are added to this emulsion.

Sample C

A conventional lith emulsion is produced which contains 80% of chloride, 19% of bromide and 1% of iodide: To 200 ml of a 1 molar $NH_4Cl$ solution containing 20 g of gelatin are added simultaneously 1000 ml of a 1 molar $AgNO_3$ solution and a mixture of 800 ml of a 1 molar $NH_4Cl$ solution containing 20 g of gelatin, 190 ml of a 1 molar $NH_4Br$ solution and 10 ml of a 1 molar $NH_4I$ solution.

All three samples were processed further according to the information in Example 1 and exposed and developed according to the methods given there. The values for sensitivity and dot quality obtained thereby are compiled in Table 3.

Table 3.

| Sample | Relative sensitivity (3 min/20° C) | Dot quality |
|---|---|---|
| A | 460 | 2.5 |
| B | 500 | 3.0 |
| C | 220 | 3.0 |

EXAMPLE 4

Sample A

A core/shell emulsion with a chloride/bromide ratio of 70/30 is produced as follows: To 310 ml of a 1 molar $NH_4Cl$ solution, that contains 20 g of gelatin, is added rapidly 600 ml of a 0.5 molar solution of $AgNO_3$. Conversion is accomplished through addition of an equimolar quantity of an $NH_4Br$ solution.

To precipitate on a chloride shell, 700 ml of a 1 molar $AgNO_3$ solution and 400 ml of a 1 molar $NH_4Cl$ solution containing 20 g of gelatin are added to this emulsion.

Sample B

A core/shell emulsion with a chloride/bromide ratio of 70/30 is produced according to the disclosures of German Pat. No. 1,169,290 as follows: To 50 ml of a 5% gelatin solution are added through metering pumps, 150 ml of a 2 N $AgNO_3$ solution and 150 ml of a 2 N $NH_4Br$ solution, keeping the silver ion concentration constant automatically at the minimum solubility of AgBr. The gelatin concentration is held at about 5% through addition of gelatin during the precipitation process.

Then, 350 ml of 2 N $AgNO_3$ solution and 350 ml of 2 N $NH_4Cl$ solution are added simultaneously to this emulsion, likewise using metering pumps and maintaining the silver ion concentration constant automatically at the minimum of solubility of AgCl and holding the concentration of gelatin at 5%.

Both samples were processed further according to the information given in Example 1 and exposed and developed according to the methods given there. The values for sensitivity and dot quality obtained thereby are compiled in Table 4:

Table 4.

| Sample | Relative sensitivity (3 min/20° C) | Dot quality |
|---|---|---|
| A | 200 | 2 |
| B | 60 | 3.0 |

The substantial advantage of the present invention consists in that photographic emulsions with a core/-shell structure and a narrow grain-size distribution can be produced that are superior with regard to general sensitivity both to the previously known emulsions of this type and the conventional, predominantly chloride-containing lith emulsions.

Moreover, it is an advantage that emulsion-producing arrangements with expensive metering and controlling devices, such as are necessary for the process of German Pat. No. 1,169,290, can be dispensed with. According to the process of the invention, running in of solutions is accomplished with conventional methods, that is, without any additional expense for apparatus and in substantially shorter times than in the pAg controlled running in of the German Pat. No. 1,169,290.

What is claimed is:

1. A process for producing a light-sensitive lithographic silver halide emulsion with a core/shell structure exhibiting improved halftone dot quality and increased photographic speed, comprising: (1) precipitating a silver chloride emulsion in a protective colloid, (2) converting said silver chloride emulsion into a silver bromide emulsion, and (3) precipitating a silver chloride shell on the surfaces of the silver bromide grains.

2. A process for producing a light-sensitive lithographic silver halide emulsion with a core/shell structure exhibiting improved halftone dot quality and increased photographic speed, comprising: (1) precipitating a silver chloride emulsion in a protective colloid, (2) converting said silver chloride emulsion into a silver bromide emulsion, and (3) in the presence of chloride liberated in the aforesaid conversion adding silver nitrate solution to the unwashed converted silver bromide emulsion to precipitate silver chloride on the surface of the silver bromide grains, to produce an emulsion containing grains in which a core of converted silver bromide is coated with a shell of silver chloride.

3. The process of claim 2 wherein the quantity of precipitated silver chloride is formulated so that at the end of the precipitation the chloride molar fraction amounts to at least 50%.

4. The process of claim 2 wherein the quantity of silver chloride precipitated on the surface of the silver bromide grains is formulated so that at the end of the precipitation the chloride/bromide molar ratio is located between 70/30 and 90/10.

5. The process of claim 2 wherein in Step 2 conversion of the silver chloride emulsion into a silver bromide emulsion is performed by contacting the silver chloride emulsion with an aqueous bromide solution containing about 1 mole percent of a water-soluble iodide whereby the silver bromide cores of the grains of the emulsion will contain about 1 mole percent of silver iodide.

6. The process of claim 2 wherein in Step 3 a solution of a water-soluble chloride is added simultaneously with the silver nitrate solution, said chloride solution containing about 1 mole percent of a water-soluble iodide, whereby the silver chloride shells of the grains of the emulsion will contain about 1 mole percent of silver iodide.

* * * * *